US005927210A

United States Patent [19]

Hacker

[11] Patent Number: 5,927,210

[45] Date of Patent: Jul. 27, 1999

[54] KEYBOARD-TO-LAP HOLDING DEVICE

[75] Inventor: Douglas G. Hacker, Seattle, Wash.

[73] Assignee: The Big H Corporation, Shoreline, Wash.

[21] Appl. No.: 08/893,897

[22] Filed: Jul. 11, 1997

[51] Int. Cl.[6] ..... A47B 23/00

[52] U.S. Cl. ..... 108/43

[58] Field of Search ..... 108/43, 42; 24/306, 24/265 H, 182, 185

[56] References Cited

U.S. PATENT DOCUMENTS

| | | | |
|---|---|---|---|
| 3,215,453 | 11/1965 | Malcom, Jr. | 108/43 X |
| 3,994,048 | 11/1976 | Rosenthal | 24/306 |
| 4,220,302 | 9/1980 | Hampton et al. | 24/306 X |
| 4,494,754 | 1/1985 | Wagner, Jr. | 108/43 X |
| 5,104,076 | 4/1992 | Goodall, Jr. | 24/306 X |
| 5,174,483 | 12/1992 | Moore, IV et al. | 24/306 X |
| 5,263,423 | 11/1993 | Anderson | 108/43 |
| 5,409,286 | 4/1995 | Huang | 24/265 H |
| 5,607,091 | 3/1997 | Musacchia | 108/43 X |
| 5,623,869 | 4/1997 | Moss et al. | 108/43 |
| 5,682,652 | 11/1997 | Brody et al. | 24/265 H |

*Primary Examiner*—Jose V. Chen

[57] ABSTRACT

A computer keyboard holding device, designed to keep the keyboard on the computer operator's lap comprising: A leg strap encircling one leg and adjustably fixed above the knee of the computer operator. A holding mechanism consisting of one clip to hook the bottom of the keyboard and a second clip to hook the top of the keyboard. The two clips are mounted in an opposing fashion on elastic. The keyboard holding mechanism, which is attached to the leg strap, lies on the top portion of the operator's leg. The two opposing clips hold the keyboard gaining a small mechanical advantage from the elastic as it stretches. It is an ergonomic device.

2 Claims, 4 Drawing Sheets

FIG. 2
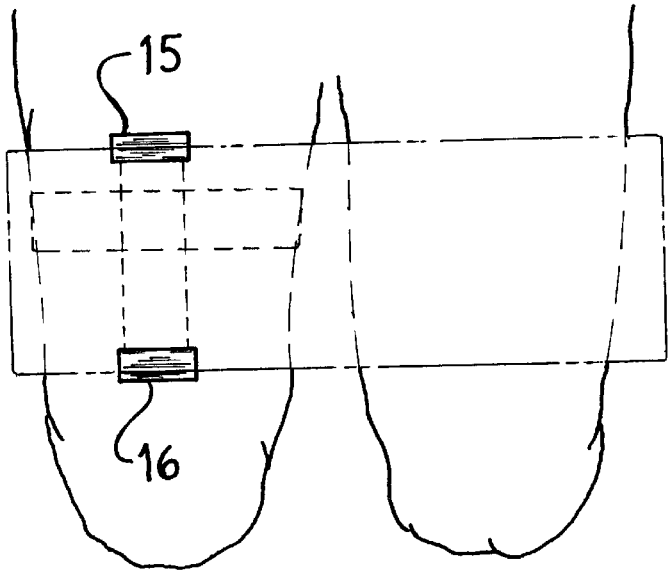
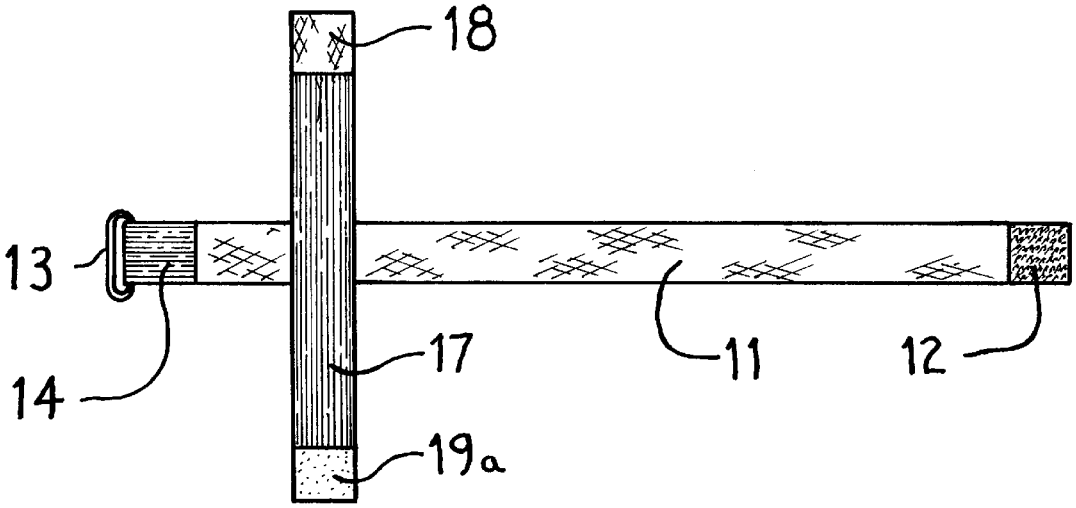
FIG. 3

FIG. 4
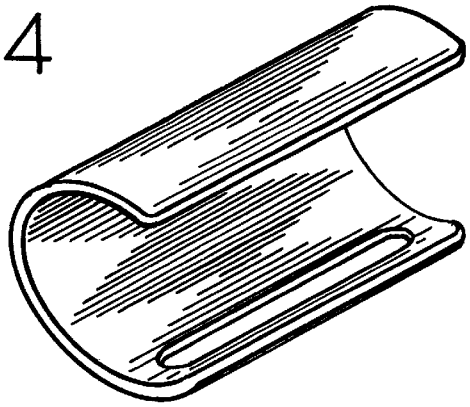
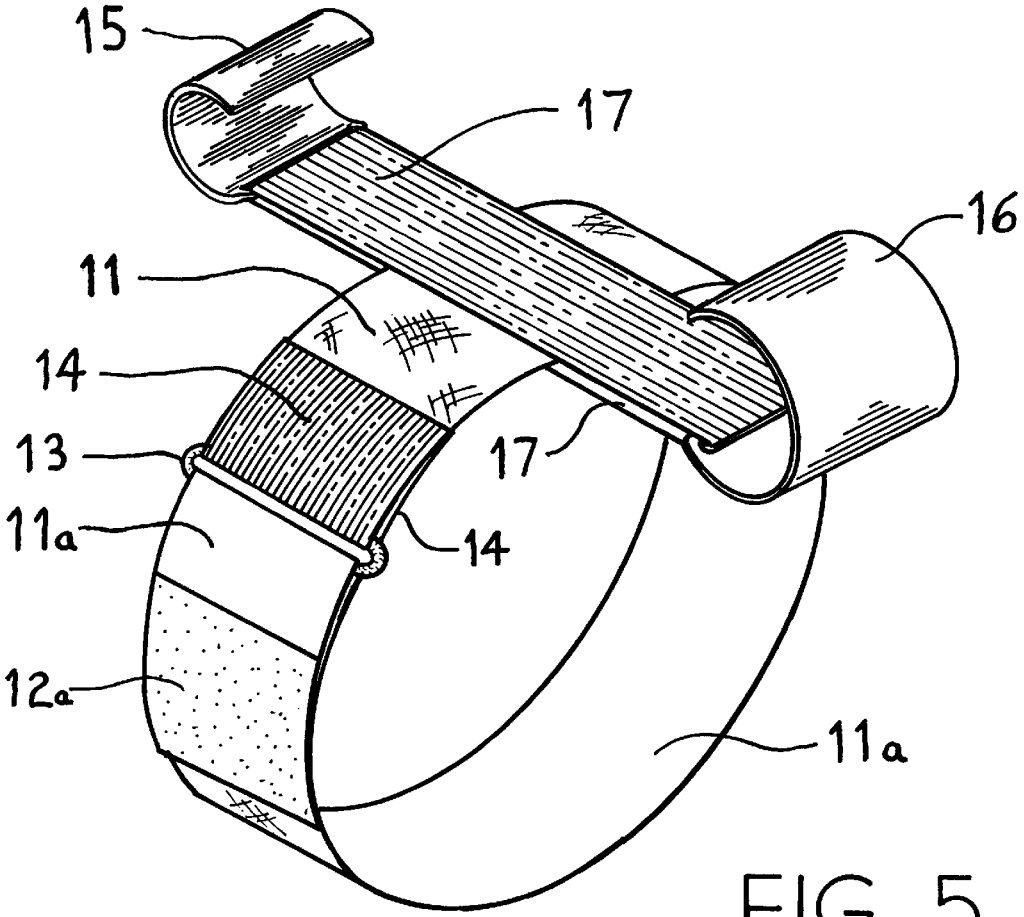
FIG. 5

FIG. 6
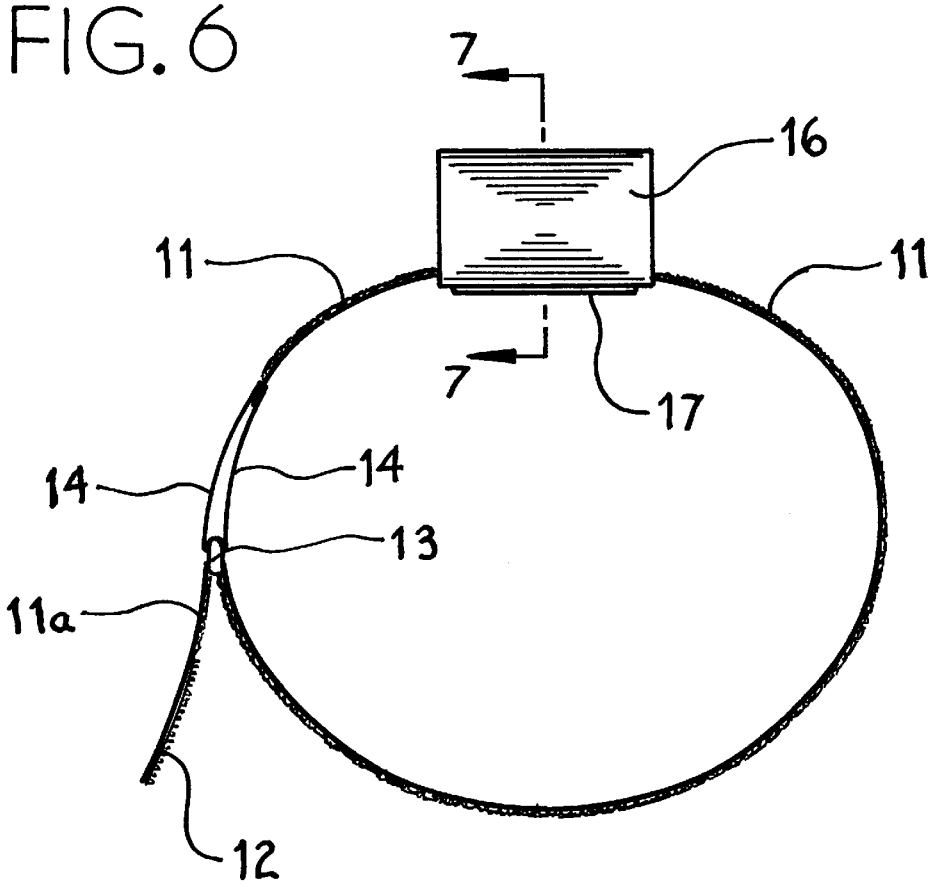
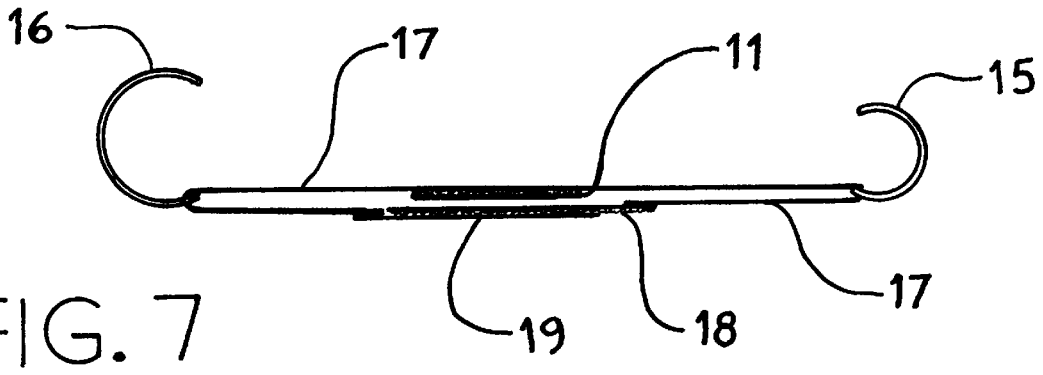
FIG. 7

KEYBOARD-TO-LAP HOLDING DEVICE

BACKGROUND OF THE INVENTION

The invention relates directly to the use of a personal computer by means of a keyboard and to an article holding device attached to a person between the hip and the knee. At convenient times it is a practice, while sitting, for the computer operator to place the computer keyboard on his/her lap. The invention is an adjustable device that restrains the keyboard at or near a desired location on the operator's lap. When the keyboard is so restrained the operator gains freedom of movement allowing for comfortable and efficient operation. Elastic makes the device soft and supple in its application and accommodates variation. Elastic also provides a small mechanical advantage in the keyboard holding mechanism, enough to restrain the keyboard on the operator's lap. It is an ergonomic device.

SUMMARY OF THE INVENTION

Many computer operators place the computer keyboard on their lap while operating casually or for an extended period. The present invention is a convenient and effective device for holding the keyboard on the operator's lap. The keyboard, unrestrained, has a tendency to slide off of the lap of the operator. With the device the operator may move, stretch and use the keyboard without holding it at the same time. This holding device prevents the keyboard from falling to the floor while the operator reaches, leans and interfaces with the computer.

Using the keyboard on the lap allows the operator to relax and assume a casual position that lends itself to extended periods of use.

The present invention, when not being used, may be stored in a small place such as a shirt pocket. This aspect of its design makes it completely portable.

The leg strap encircles one of the operator's legs above the knee. The keyboard holding mechanism, attached to the leg strap, lies on the top portion of the operator's leg. The keyboard holding mechanism uses opposing clips mounted on elastic strap material. This elastic allows adjustment to keyboards of different sizes. The keyboard is placed between the clips where the elastic is also employed to gain a small mechanical advantage, holding the keyboard on the operator's lap.

DESCRIPTION OF THE DRAWINGS

FIG. 2 Is a top view of the device holding the keyboard on the operator's lap.

FIG. 3 Is a top view of the device laid flat without the clips.

FIG. 4 Displays a clip in an isometric view.

FIG. 5 Is an isometric view displaying the device in use, eliminating the operator and the keyboard from view.

FIG. 6 Is a front view displaying the device in use, as in FIG. 5, with the leg strap hook type released.

FIG. 7 Is a section view along the line 7—7 in FIG. 6.

DESCRIPTION OF THE PREFERRED EMBODIMENT

Figure 1:
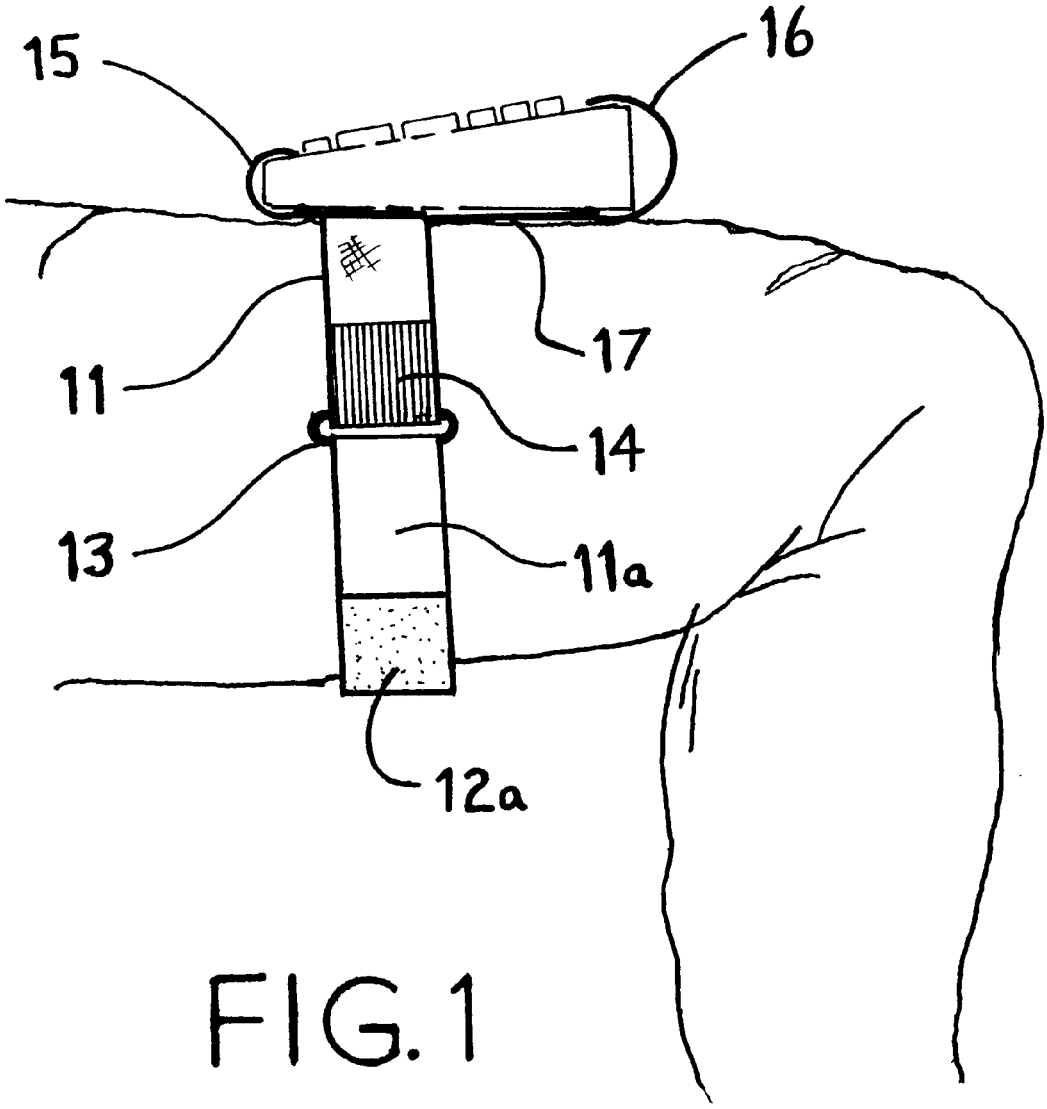
FIG. 1 Is a side view of the device holding the computer keyboard (the keyboard) on the computer operator's (the operator's) lap.

In the drawings, where operator means computer operator, keyboard means computer keyboard, hook type means hook-type strap material, loop type means loop-type strap material, and where an "a" reference means the underside of either the hook-type or loop-type strap material;

FIG. 1 shows the keyboard clipped in the holding device on the operator's lap. The loop type leg strap 11 and 11*a*, encircles one of the operator's legs. Attached at the first end of the leg strap is a short piece of hook type 12*a* which is passed through the transverse ring 13. The ring is attached to the second end of the loop type leg strap 11 with elastic material 14. Said attachment is made by passing a length of elastic material 14 through the transverse ring 13 and attaching both ends of said elastic to the second end of the loop-type leg strap 11. The first end 12*a* doubles back on the leg strap and is adjustably fixed hook to loop. The keyboard holding mechanism lies on the top portion of the operator's leg. Shown are the base clip 15 and the top clip 16. Attached at right angles to the leg strap, the second piece of elastic 17 holds both clips to the leg strap. The keyboard lies across the operator's legs. The holding device restrains the keyboard on the operator's lap.

FIG. 2 looking down on the keyboard on the operator's lap, the top clip 15 and the bottom clip 16 are visible.

In FIG. 3 the device without clips is laid out flat. The leg strap 11 is loop type. At the first end of the leg strap, hook type 12 is attached. Elastic material 14 passes through a slotted ring 13, and both ends of the elastic material are attached to the second end of the leg strap 11, holding the ring to the leg strap. A second piece of elastic material 17 is attached to the leg strap 11 at right angles. At the first end of this second piece of elastic a piece of loop type 18 is attached and at its second end a piece of hook type 19*a* is attached.

FIG. 4 is an isometric view of the clip, commonly made of plastic. Clips vary in size. The clip is a hollow right circular cylinder with a full section removed by passing a plane through the cylinder at right angles to the ends. The drawing also shows the clip with rounded corners. The elastic of the holding mechanism passes through the straight slot along one of the straight sides. This elegant shape holds any keyboard.

FIG. 5 is an isometric view of the device in use as it is employed in FIG. 1 and FIG. 2 without representation of the operator or the keyboard. It shows the loop type leg strap 11 & 11*a*, the hook type 12*a* at it's first end and the transverse ring 13 at it's second end. The first end 12*a* passes through the ring 13, doubles-back on the leg strap and fixes hook to loop. The elastic 14, which holds the ring 13 to the loop type leg strap, allows for comfort and compliance of the leg strap. The parts of the holding mechanism shown are the second piece of elastic 17 attached at right angles to the leg strap, the base clip 15 and the top clip 16. This second piece of elastic allows for keyboards of different sizes and achieves a small mechanical advantage as it stretches when the base clip 15 and the top clip 16 are fixed to the keyboard.

FIG. 6 Is a front view of the device in use as it is employed in FIG. 1 and FIG. 2 without representation of the operator or the keyboard. The leg strap 11 & 11*a* is shown with the hook type first end 12 passed through the ring 13, at its second end with hook released. The elastic 14, the top clip 16, and the second piece of elastic 17 are also in view.

FIG. 7 is a cross-section of FIG. 6 at the line 7—7. It shows the leg strap 11, and the second piece of elastic 17. The loop type 18 attached to the first end of the second piece of elastic 17 passes through the slot in the base clip 15. The hook type 19 attached to the second end of the second piece of elastic 17 passes through the slot in the top clip 16. The ends, 18 & 19, are mated hook to loop and the clips oppose each other.

I claim:

1. A holding device that restrains a computer keyboard on a computer operator's lap comprising:

a leg strap having a first end and a second end made of loop type strap material;

a piece of hook type strap material attached at said first end of said leg strap;

a transverse ring attached to said second end of said leg strap by a first piece of elastic material whereby said leg strap encircles one of an operator's leg by passing said first end through said transverse ring and doubles back on itself to adjustably fix the hook type strap to the loop type strap material when the holding device is in use;

a keyboard holding mechanism comprising:

a second piece of elastic strap material attached at a right angle to said leg strap;

a second piece of loop type material attached to a first end of said second piece of elastic material;

a second piece of hook type strap material attached to a second end of said second piece of elastic material;

a base clip means adapted to engage a bottom end of a keyboard, said base clip means including a slot in which the first end of the second piece of elastic material is inserted;

a top clip means adapted to engage a top end of the keyboard, said top clip means including a slot in which the second end of the second piece of elastic material is inserted whereby the first end of the second piece of elastic material is mated with the second end of the second piece of elastic material, such second piece of material passing under said leg strap when in use so that the keyboard holding mechanism lies on a top portion of an operator's leg, the keyboard is placed between the two clip means.

2. The holding device of claim 1 wherein the clip means is a hollow right circular cylinder with a section removed.

* * * * *